US008256649B2

(12) United States Patent
Camp

(10) Patent No.: US 8,256,649 B2
(45) Date of Patent: Sep. 4, 2012

(54) CLOTHES HANGER WITH DOOR HOOK AND CLOSET ROD HOOK

(76) Inventor: Donna D. Camp, Newport Beach, CA (US)

( * ) Notice: Subject to any disclaimer, the term of this patent is extended or adjusted under 35 U.S.C. 154(b) by 23 days.

(21) Appl. No.: 12/807,194

(22) Filed: Aug. 30, 2010

(65) Prior Publication Data

US 2011/0139832 A1 Jun. 16, 2011

Related U.S. Application Data

(63) Continuation-in-part of application No. 29/348,253, filed on Dec. 15, 2009, now Pat. No. Des. 645,262.

(51) Int. Cl.
*A41D 27/22* (2006.01)

(52) U.S. Cl. ..... 223/85; 223/DIG. 4

(58) Field of Classification Search ..... 223/85, 223/88, DIG. 4, 92, 95
See application file for complete search history.

(56) References Cited

U.S. PATENT DOCUMENTS

| | | | | |
|---|---|---|---|---|
| 1,760,290 | A * | 5/1930 | Tammarazzo | 223/88 |
| 1,996,552 | A * | 4/1935 | Schwender | 223/85 |
| 2,214,118 | A * | 9/1940 | Bracken | 223/85 |
| 2,461,178 | A * | 2/1949 | Reinke | 223/88 |
| 2,489,492 | A | 11/1949 | Kleber | |
| 2,609,104 | A * | 9/1952 | Leach | 211/113 |
| 2,701,082 | A | 2/1955 | Cohen | |
| 2,808,942 | A * | 10/1957 | Harrison et al. | 223/88 |
| 3,001,676 | A | 9/1961 | Glotzer | |
| 3,131,817 | A * | 5/1964 | Schenkler | 223/85 |
| 3,157,324 | A * | 11/1964 | Barnes | 223/88 |
| 3,350,754 | A * | 11/1967 | Ballenger et al. | 223/96 |
| 3,726,452 | A * | 4/1973 | Jaffe | 223/91 |
| 4,261,490 | A | 4/1981 | Schwartzstein | |
| 5,085,357 | A | 2/1992 | Chen | |
| 5,433,355 | A * | 7/1995 | Watkins | 223/DIG. 4 |
| 5,649,652 | A | 7/1997 | Sackett et al. | |
| 7,731,068 | B2 * | 6/2010 | Scicluna | 223/DIG. 4 |
| 2009/0206114 | A1 | 8/2009 | Scicluna | |
| 2009/0294491 | A1 * | 12/2009 | Carver | 223/85 |

FOREIGN PATENT DOCUMENTS

DE 3302590 A1 * 8/1984

* cited by examiner

*Primary Examiner* — Nathan Durham
(74) *Attorney, Agent, or Firm* — Russo & Duckworth, LLP; David G. Duckworth

(57) ABSTRACT

A clothes hanger is provided including a hanger body and a hook assembly. The hanger body includes a pair of laterally and downwardly extending arms which connect at a central apex. The hook assembly is connected to the hanger body apex so as to rotate about a horizontal axis. The hook assembly includes a clothes rod hook and a door hook which extend in opposite directions from the hanger body's apex. The clothes rod hook includes an arcuate portion for hanging from a clothes rod having a circular cross-section. The door hook is u-shaped including a straight bar, a straight top plate, and a return flange. The door hook may be rotatable about an axis 90° relative to the axis which the hook assembly rotates about.

3 Claims, 6 Drawing Sheets

CLOTHES HANGER WITH DOOR HOOK AND CLOSET ROD HOOK

RELATED APPLICATIONS

The present application is a continuation-in-part application claiming priority to co-pending U.S. patent application Ser. No. 29/348,253 filed on Dec. 15, 2009.

BACKGROUND OF THE INVENTION

Conventional clothes hangers typically include a rigid triangular frame roughly in the shape of an isosceles triangle. A hook or the like is located at the apex of the hanger frame for attachment to a hanger rod. The shoulders of a garment, such as a shirt, coat or jacket, are draped over the upper arm members of the clothes hanger to suspend the garment in a generally upright orientation so as to reduce the risk of wrinkling. When the frame includes a horizontally extending stiffening member, garments such as pants or trousers may be draped over the stiffening member to reduce the risk of wrinkling or creasing the garment.

A wide variety of hangers have been developed to meet a variety of needs. For example, U.S. Pat. No. 7,644,844 describes a clothes hanger wherein the frame arms are retractable so as to accept garments of different sizes. U.S. Pat. No. 7,172,102 describes a collapsible clothes hanger. U.S. Pat. No. 6,296,160 describes a coat hanger including hoops and clips for holding ties, scarfs and belts. U.S. Pat. No. 7,641,084 describes a coat hanger which also has adjustable arms for accepting clothes of different sizes. U.S. Pat. No. 4,714,183 describes a plastic coat hanger having stiffening members. U.S. Pat. No. 6,152,313 describes a clothes hanger rack for affixing to the top of a door. The rack includes u-shaped hooks with flat surfaces so as to affix to a door. Moreover, the rack includes a plurality of hooks for accepting clothes or for accepting the rounded hooks of traditional coat hangers.

Unfortunately, each of the aforementioned clothes hangers suffer from serious disadvantages. Foremost, none of the prior art coat hangers are suitable for affixing to both a traditional clothes rod having a circular cross-section and to the top of a door having a flat upper surface. Thus, there is a need for a clothes hanger that is capable of affixing to both round rods and flat surfaces like a door.

Further, it would be desirable to provide a clothes hanger which was lightweight and inexpensive to manufacture.

SUMMARY OF THE INVENTION

The present invention addresses the aforementioned disadvantages by providing an improved clothes hanger. The clothes hanger includes a hanger body and a hook assembly. The hanger body includes a pair of traditional laterally and downwardly extending arms for supporting the shoulder area of a garment such as a shirt or jacket. The laterally extending arms have outer ends and join at the center to form the hanger body apex. Though not necessary, the hanger body may include a stiffening bar which extends horizontally from the outer end of one hanger body arm to the outer end of the other hanger body arm. Where the hanger body includes the horizontal stiffening bar, the hanger body will substantially form an isosceles triangle wherein the arms form the equal sides of the triangle. For purposes herein, the description of the body forming a triangle is intended to be interpreted loosely. For example, the hanger body arms may project both downwardly and forwardly so as to more accurately simulate a person's shoulders to support jackets or coats.

The clothes hanger hook assembly is connected to the hanger body at the hanger body's apex. Moreover, the hook assembly is rotatably connected to the hanger body apex so as to rotate about a horizontal axis. Furthermore, the hook assembly includes a clothes rod hook including a curved-arcuate portion constructed in similar form to a traditional rounded hook found on common clothes hangers utilized for hanging from a traditional clothes rod having a circular cross-section. In addition, the hook assembly includes a door hook constructed in similar form to hooks intended to affix to the top of a door having a flat upper surface. To this end, the door hook includes a bar which extends from the hanger body apex. At the end of the bar, the door hook includes a straight top plate which extends at substantially 90° from the end of the bar. It is this straight top plate which is intended for being positioned on top of a door. Finally, the door hook includes a flange which extends substantially 90° from the top plate so as to form a substantially u-shaped structure with the door hook bar and top plate.

In operation, the door hook assembly is rotatable about the horizontal axis to two positions. In a first position, the clothes rod hook is rotated to its uppermost position so as to be positionable upon a clothes rod having a circular cross-section. In a second position, the hook assembly is rotatable about its horizontal axis so that the door hook is positioned at its highest point so as to be positioned upon the top surface of a door.

In a preferred embodiment, the door hook is also rotatable about an axis 90° relative to the hook assembly's horizontal axis. In other words, the door hook can rotate about the hook assembly's horizontal axis with the rotation of the clothes rod hook. In addition, the door hook is rotatable independently of movement or rotation of the clothes rod hook so as to allow the door hook to twist about its central axis so as to be flush within the hanger body's vertical plane when rotated downwardly when the clothes rod hook is in use, but also be rotated 90° relative to the hanger body's vertical plane so as to affix to the top of a door when the door hook is rotated to its uppermost position.

The clothes rod hook may, or may not, be rotatable about an axis 90° relative to the hook assembly's horizontal axis. However, in the preferred embodiment, the clothes rod hook is not rotatable except for rotating about the hook assembly's horizontal axis, and thus preferably the clothes rod hook resides substantially in the hanger body's substantially vertical plane when the hook assembly is rotated either to its uppermost or lowermost position.

Thus, it is an object of the present invention to provide a clothes hanger which is suitable for hanging from a clothes rod having a circular cross-section and for hanging from the top of a door having a flat upper surface.

These and other features and advantages of the present invention will be appreciated by those skilled in the art from the following detailed description taken in conjunction with the drawings.

DETAILED DESCRIPTION OF THE DRAWINGS

DETAILED DESCRIPTION OF THE INVENTION

Figure 1:
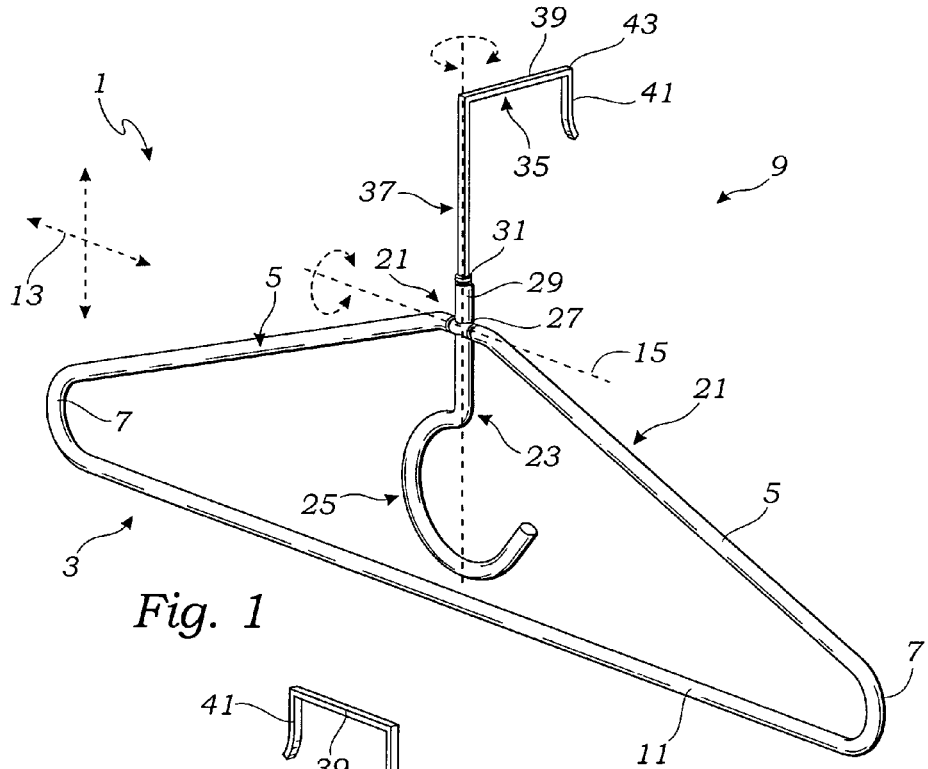
FIG. 1 is a perspective view of the clothes hanger of the present invention with the door hook positioned for hanging from the top of a door.

With reference to FIGS. 1-12, the clothes hanger 1 of the present invention includes a hanger body 3 and a hook assembly 21. The hanger body 3 is constructed similarly to traditional hanger bodies. To this end, the hanger body 3 includes a pair of hanger arms 5. Each arm 5 connects at the middle of the clothes hanger at the hanger body apex 9 and then extends laterally and downwardly from the hanger body apex until the arms terminate at their ends 7. The hanger body may or may not, include a horizontal stiffening member 11 which extends from the end 7 of one arm to the end 7 of the other arm which would form the hanger body into an isosceles triangle. For purposes of facilitating the description of the present invention, the triangle formed by the hanger body defines the hanger body's plane 13.

The hook assembly 21 is rotatably connected at the hanger body's apex 9. The hook assembly rotates about a horizontal axis 15 at the hanger body's apex 9 which resides within the hanger body plane 13. To permit the hook assembly to rotate about a horizontal axis, the hook assembly includes a tube 27 through which the hanger body's apex projects.

Figure 11:
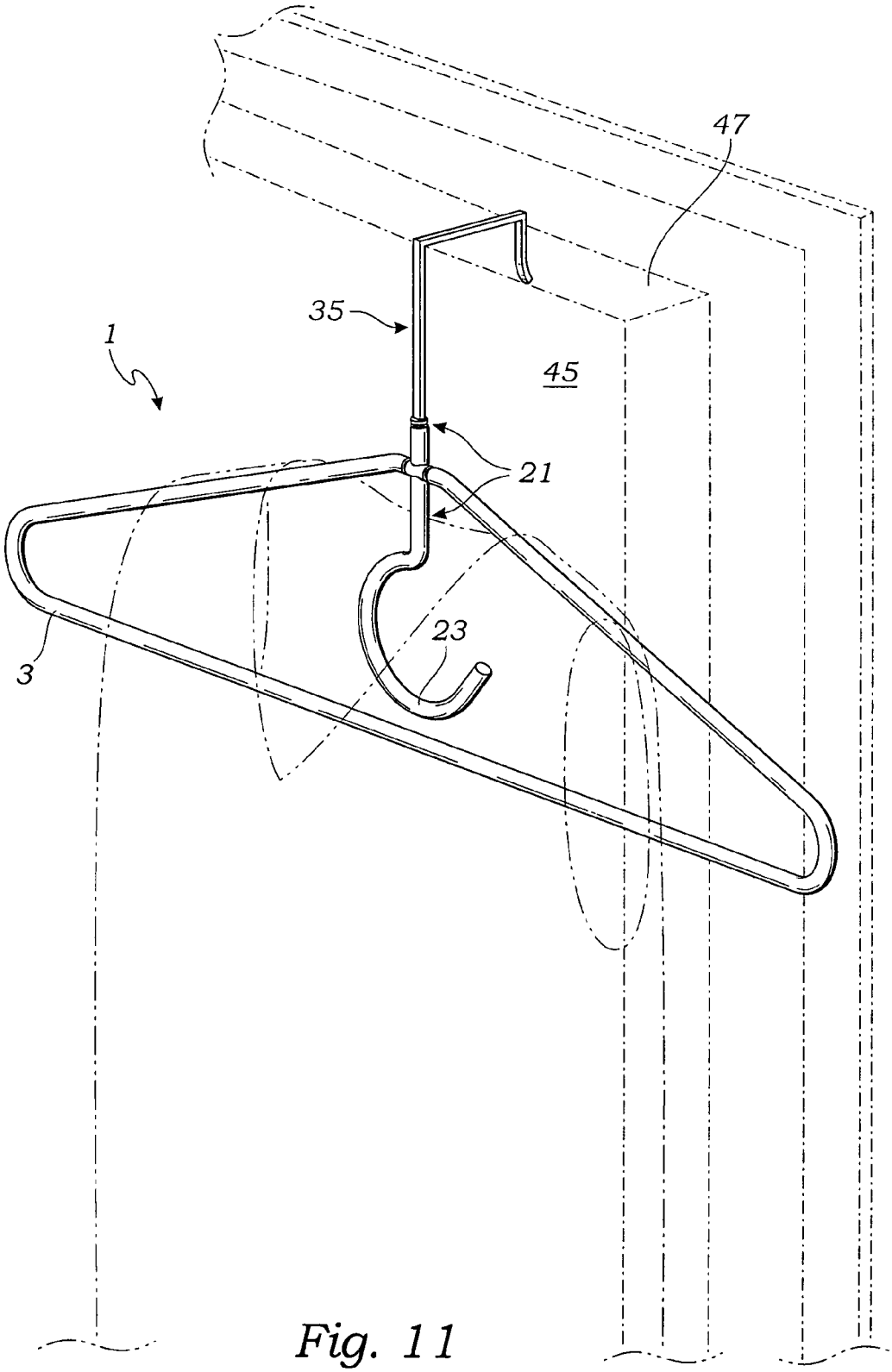
FIG. 11 is a perspective view of the clothes hanger of the present invention in use hanging from a door and supporting a garment.
Figure 12:
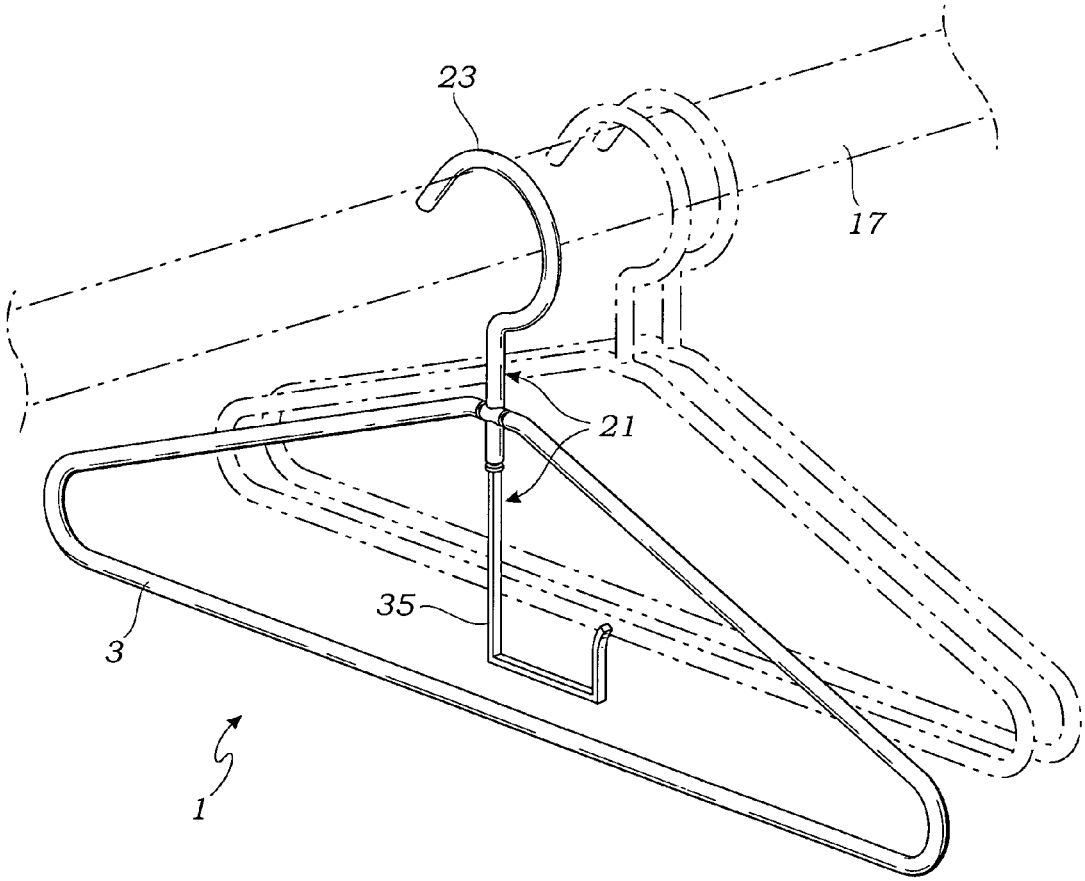
FIG. 12 is a perspective view of the clothes hanger of the present invention positioned so as to hang from a clothes rod having a circular cross-section.

The hook assembly 21 includes a clothes rod hook 23 and a door hook 35. As illustrated in the figures, each hook extends opposite one another from the hook assembly's tube 27. The clothes rod hook includes an arcuate support 25 which, as illustrated in FIG. 12 is constructed for hanging from a clothes rod 17 having a circular cross-section. Meanwhile, the door hook 35 extends from the hook assembly's tube in the opposite direction of the clothes rod hook 23. The door hook 35 includes a bar 37, a top plate 39, and a flange 41. The door hook bar 37 extends from the hook assembly's tube 27 to engage the top plate 39. The top plate extends at substantially 90° from the door hook bar and is constructed for being positioned to hang from the flat surface of the top of a door. Extending downwardly from the outer extremity of the top plate 39 is the flange 41 for preventing the hook from inadvertent disengagement from the top of a door, as illustrated in FIG. 11.

Figure 2:
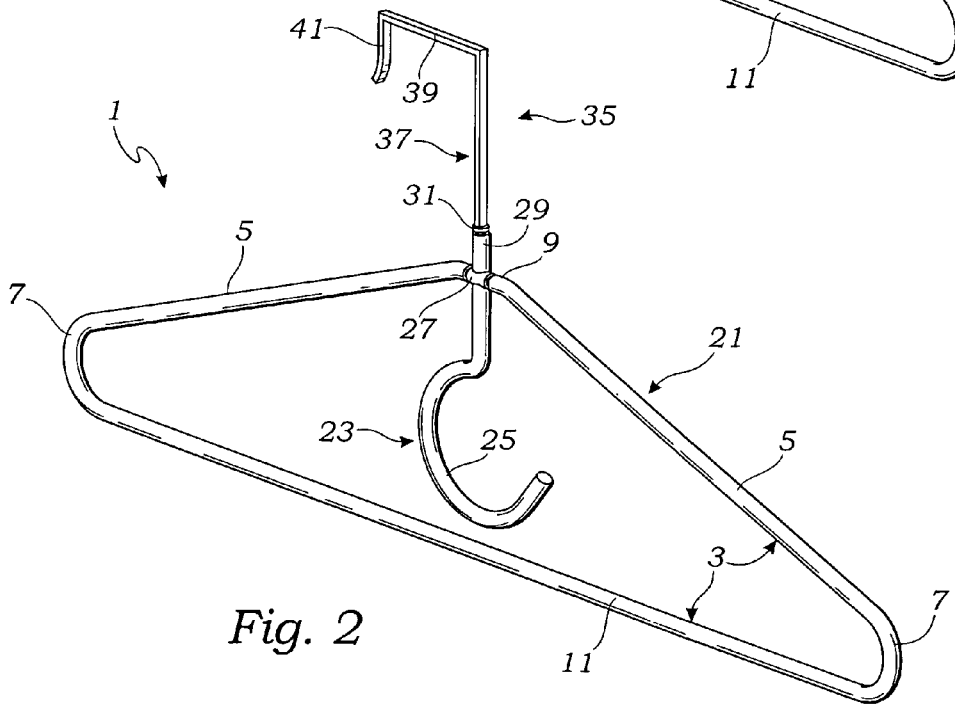
FIG. 2 is a perspective view of the clothes hanger of the present invention with the door hook rotated to be within the plane of the hanger body.
Figure 3:
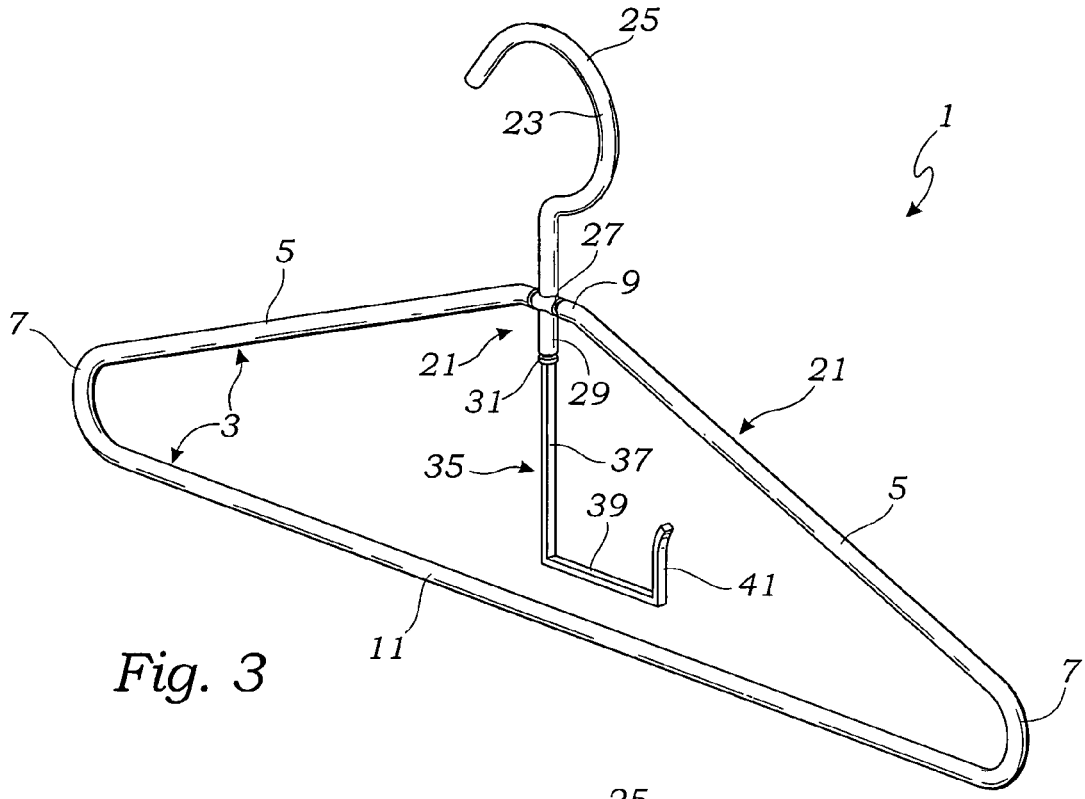
FIG. 3 is a perspective view of the clothes hanger of the present invention with the hanger assembly rotated so that the clothes rod hook is positioned for hanging from a clothes rod.
Figure 4:
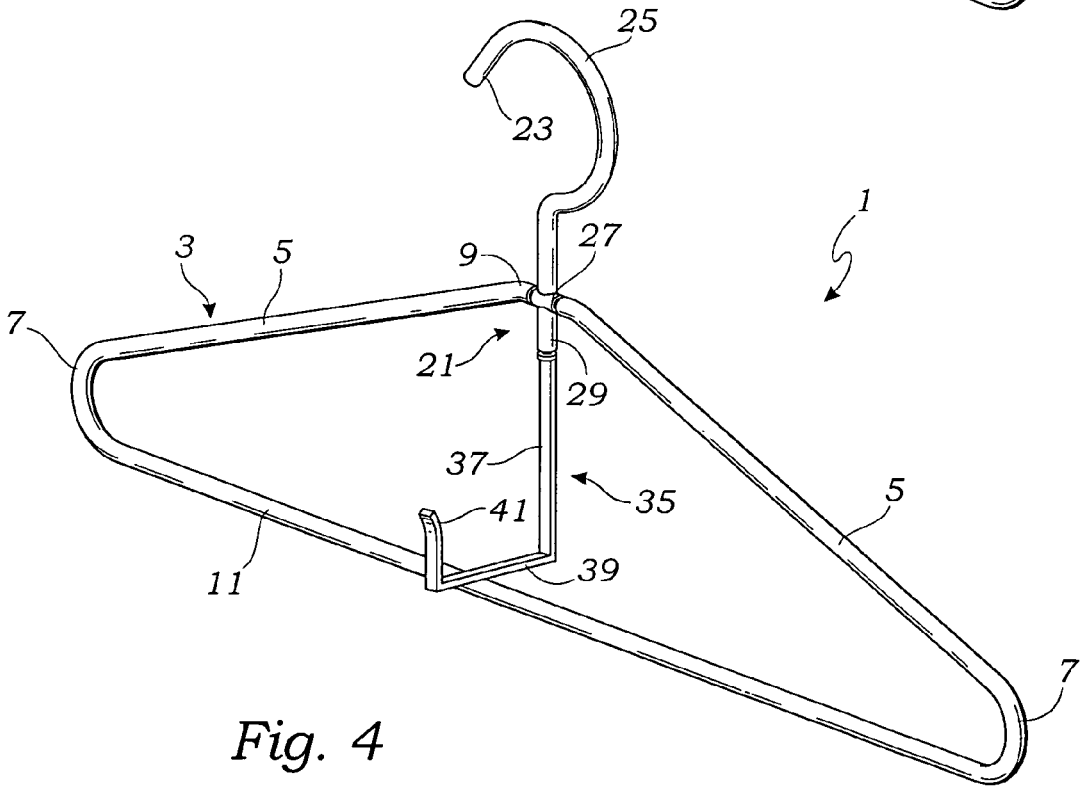
FIG. 4 is a perspective view of the clothes hanger of the present invention illustrating that the door hook can be rotated independently of rotation of the hook assembly.
Figure 5:
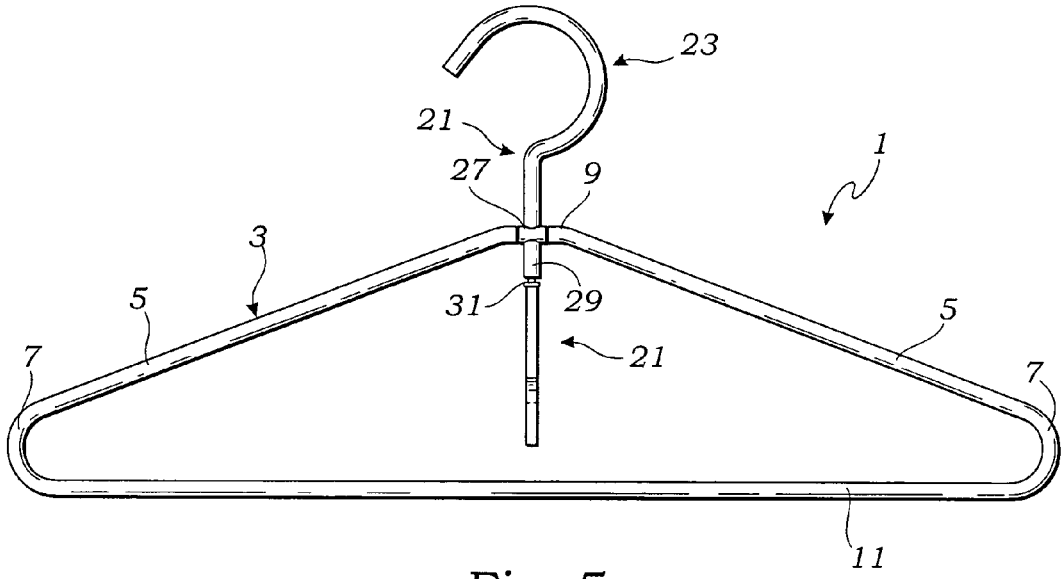
FIG. 5 is a front view of the clothes hanger illustrated in FIG. 4.
Figure 6:
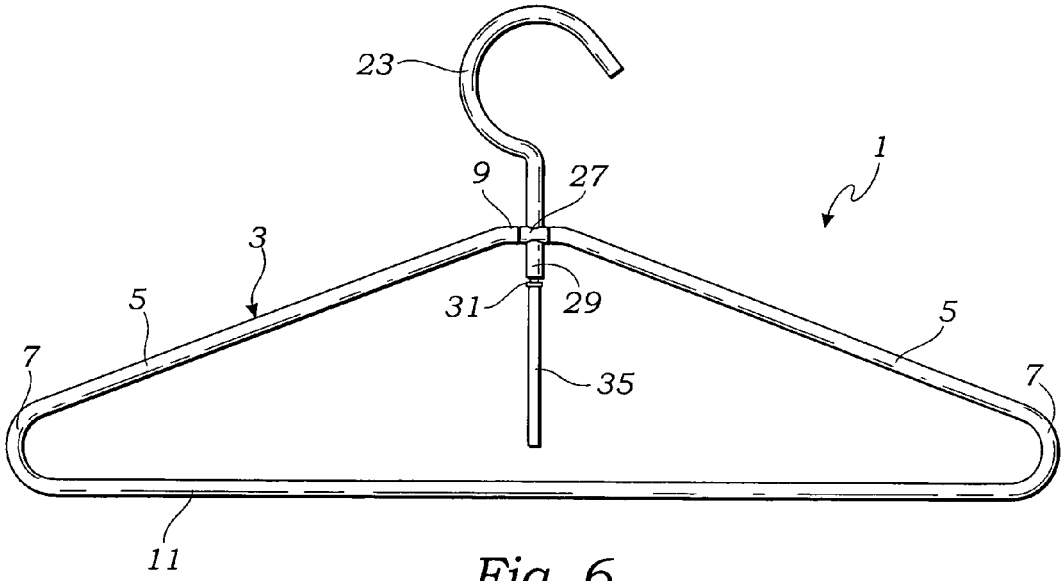
FIG. 6 is a rear view of the clothes hanger illustrated in FIG. 4.
Figure 8:
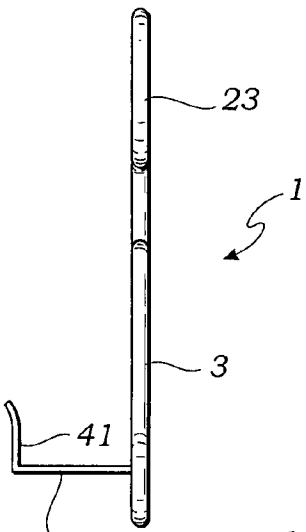
FIG. 8 is a right side view of the clothes hanger illustrated in FIG. 4.
Figure 7:
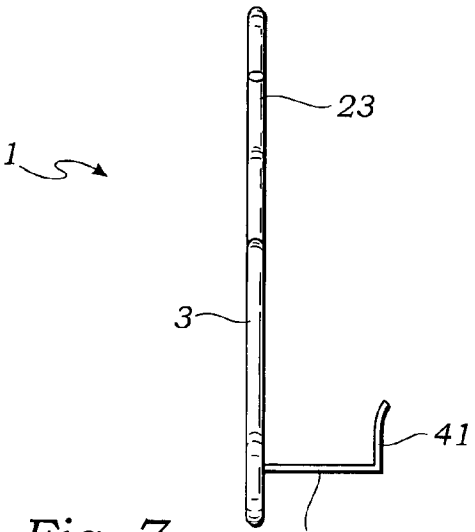
FIG. 7 is a left side view of the clothes hanger illustrated in FIG. 4.
Figure 9:
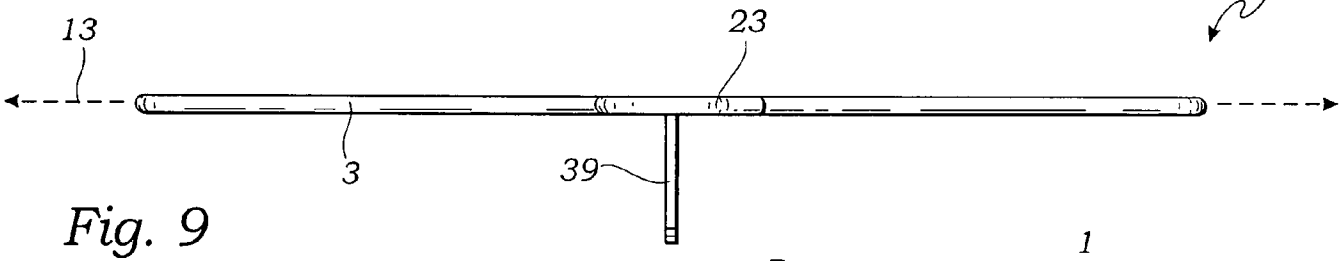
FIG. 9 is a top plane view of the clothes hanger illustrated in FIG. 4.
Figure 10:
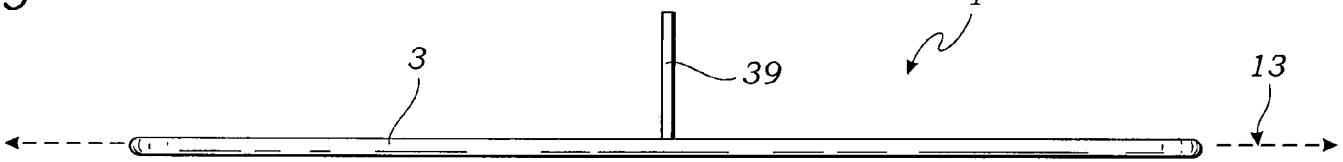
FIG. 10 is a bottom plane view of the clothes hanger illustrated in FIG. 4.

Advantageously, the door hook's bar 37 is rotatably attached to the assembly's tube 27. As illustrated in the figures, the hook assembly 21 includes a cup 29 which extends at a 90° angle relative to the apex's horizontal axis. The cup 29 includes a central bore 31 for rotatable receipt of the door hook's bar 37 so as to allow the door hook bar 37 as well as the door hook 35 as a whole, to rotate about an axis 90° relative to the apex's horizontal axis. Advantageously, rotation of the door hook allows the door hook to be positioned 90° from the hanger body's plane, as illustrated in FIGS. 1, and 4-11, and to allow the door hook 35 to be rotated to within the hanger body's plane 13 as illustrated in FIGS. 2 and 12.

While several particular forms of the invention have been illustrated and described, it will be apparent that various modifications can be made without departing from the spirit and scope of the invention. Therefore, it is not intended that the invention be limited except by the following claims. Having described my invention in such terms as to enable a person skilled in the art to understand the invention, recreate the invention and practice it, and having presently identified the presently preferred embodiments thereof,

I claim:

1. A clothes hanger comprising:

a hanger body including a pair of laterally extending arms having outer ends, said arms connecting at a hanger body apex with said arms and apex defining a substantially vertical plane;

a hook assembly rotatably connected at said hanger body apex so as to rotate about a horizontal axis so as to define the hook assembly's horizontal axis, said hook assembly including:

a clothes rod hook which extends from said hanger body apex, said clothes rod hook including an arcuate portion sized for affixing upon a clothes rod having a circular cross-section; and a door hook including a substantially straight bar which extends from said hanger body apex opposite said clothes rod hook at substantially 90° from said horizontal axis to define a second axis, a substantially straight top plate extending at substantially 90° from said bar for being positioned atop a door, and a flange extending toward said hanger body at substantially 90° from said top plate;

said door hook is rotatable about said second axis and said clothes rod hook is not rotatable about said second axis when said hanger body remains stationary;

said hook assembly is rotatable about the horizontal axis to a first position so that said clothes rod hook is positionable upon a clothes rod having a circular cross section, and said hook assembly is rotatable about the horizontal axis to a second position so that said door hook is positionable upon the top of a door, said clothes rod hook resides substantially in the hanger body's substantially vertical plane when said hook assembly is rotated to said hook assembly's first position or rotated to said hook assembly's second position.

2. The clothes hanger of claim 1 wherein said hook assembly further includes:

a horizontally aligned tube for rotatable receipt of said hanger body apex so as to allow said hook assembly to rotate about a horizontal axis; and a bore for rotatable receipt of said door hook bar so as to enable said door hook to be rotatable about an axis 90° relative to said hook assembly's horizontal axis.

3. The clothes hanger of claim 1 wherein said hanger body includes a stiffener beam which extends horizontally from the outer end of one hanger body arm to the outer end of the other hanger body arm to form said hanger body into an isosceles triangle.

* * * * *